US005887644A

United States Patent [19]

Akiyoshi et al.

[11] Patent Number: 5,887,644

[45] Date of Patent: Mar. 30, 1999

[54] ROLL COOLING STRUCTURE FOR TWIN ROLL CONTINUOUS CASTER

[75] Inventors: Ryo Akiyoshi, Kawasaki; Masayoshi Hori; Kunio Matsui, both of Yokohama; Atsushi Hirata, Hiratsuka; Koichi Fujita; Shu Ogawa, both of Yokohama, all of Japan

[73] Assignees: Ishikawa Jima-Harima Heavy Industries Company Limited, Tokyo, Japan; BHP Steel (JLA) Pty Ltd., Melbourne, Australia

[21] Appl. No.: 801,925

[22] Filed: Feb. 14, 1997

[30] Foreign Application Priority Data

Feb. 16, 1996 [AU] Australia ..... PN8113

[51] Int. Cl.[6] ..... B22D 11/06; B22D 11/124

[52] U.S. Cl. ..... 164/428; 164/429; 164/442; 164/443; 492/46

[58] Field of Search ..... 164/428, 429, 164/442, 443, 480, 479, 485; 492/46

[56] References Cited

U.S. PATENT DOCUMENTS

| | | | |
|---|---|---|---|
| 4,773,468 | 9/1988 | Lauener | 164/428 |
| 4,809,768 | 3/1989 | Sato et al. | 164/428 |
| 5,228,497 | 7/1993 | Romanowski | 164/428 |
| 5,651,410 | 7/1997 | Perry et al. | 164/428 |

FOREIGN PATENT DOCUMENTS

| | | | |
|---|---|---|---|
| 4-344852 | 12/1992 | Japan | 164/428 |
| 5-212506 | 8/1993 | Japan | 164/428 |

*Primary Examiner*—Patrick Ryan
*Assistant Examiner*—I.-H. Lin
*Attorney, Agent, or Firm*—Nikaido Marmelstein Murray & Oram, LLP

[57] ABSTRACT

A casting roll (18) for a twin roll continuous caster comprises a roll body (19) made of a metal material having high rigidity and a sleeve (20) made of a metal material having high thermal conductivity for covering an outer periphery of the roll body (19). A plurality of load bearing members (23) with thicker width are provided peripherally on the outer periphery of the roll body (19), the load bearing members (23) being in contact with an inner periphery of the sleeve (20) and extending axially of the roll. A plurality of fins (24) with thinner width and shorter in height than the load bearing members (23) are provided on the inner periphery of the sleeve (20) between the adjacent load bearing members (23) and extending axially of the roll, cooling water passages (25) being provided in the form of gaps defined between the roll body (19) and the sleeve (20) thereby providing a roll having sufficiently high rigidity to prevent or at least minimise damage of the cooling water passages when the solidified shells are brought together between the rolls and/or having an enhanced heat transfer area.

13 Claims, 5 Drawing Sheets

PRIOR ART

ROLL COOLING STRUCTURE FOR TWIN ROLL CONTINUOUS CASTER

TECHNICAL FIELD

This invention relates to casting rolls for the casting of metal strip. Such casting rolls may be used in a twin roll caster, although single roll casters are also known.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein the refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

FIG. 6 exemplarily illustration a twin roll continuous caster of the prior art. As shown, a pair of internally coolable casting rolls 1 and 2 are arranged horizontally and in parallel with each other with a predetermined spacing. A seal plate or dam 3 is mounted on upper portions of each of opposite ends of the rolls 1 and 2 to provide a molten metal pool 4 between the rolls 1 and 2.

A tundish 6 for supplying molten metal 5 is arranged above the pool 4 and a pouring nozzle 7 is protruded from the tundish 6 downward to the pool 4.

Further, the tundish 6 is formed at its bottom with an inert gas chamber 8 which surrounds the pool 4. The chamber 8 is partitioned into upper and lower portions by a straightening plate 9 such as punch plate and has inert gas supply ports 11 above the plate 9 for supplying inert gas 10 such as nitrogen or argon gas to prevent the molten metal 5 in the pool 4 being oxidised.

Reference numeral 12 denotes solidified shells formed on the surfaces of the rolls 1 and 2, and numeral 13 denotes the strip.

When the molten metal in the tundish 6 is supplied to the pool 4 via the nozzle 7, the molten metal 5 solidifies on the surfaces of the rolls 1 and 2. Under such condition, the rolls 1 and 2 are rotated in directions shown by the arrows so that the solidified shells 12 formed on the surfaces of the rolls 1 and 2 are brought together and pulled downward to be continuously cast as strip 13.

In the twin roll continuous caster as described above, it is important to enhance solidifying efficiency by efficiently cooling the rolls 1 and 2. In the above described caster, each of the rolls 1 and 2 comprises a roll body made of a material such as stainless steel with high rigidity and a cylindrical sleeve made of a material such as copper alloy with high thermal conductivity and mounted to cover an outer periphery of the roll body. By machining axial grooves on an inner periphery of the sleeve, cooling water passages are formed between the roll body and the sleeve, and cooling water is passed through the cooling water passages to cool the sleeve.

However, as shown in FIG. 7, in a case where the grooves are machined at a long peripheral pitch on the inner periphery of the sleeve 14 to provide the cooling water passages 16 between the sleeve and the outer periphery of the roll body 15, the overall area for heat transfer is so small that the cooling water flow rate must be extensively increased so as to ensure good thermal transfer. Thus, high supply pressure is needed to pass the cooling water, resulting in extremely high running cost.

On the other hand, as shown in FIG. 8, in a case where the grooves are machined at a shorter peripheral pitch on the inner periphery of the sleeve 14 to provide the passages 16 between the sleeve and the outer periphery of the roll body 15, each load bearing member 17 between the adjacent passages 16 has reduced width, resulting in decrease of rigidity. Disadvantageously, the load bearing member 17 may be bent and deformed due to reactive force applied when the solidified shells are brought together between the rolls 1 and 2, so that the cooling water passages 16 may be damaged.

The very fact that the sleeve 14 is made of the material such as copper alloy having high thermal conductivity, which is relatively low in rigidity, will extremely increase the possibility that the bending and deformation may occur in the case of machining the grooves at the smaller peripheral pitch.

Japanese Patent publication no. 56-17169-A proposes a casting roll construction having a much larger number of load bearing members provided in the inner surface of the sleeve than the constructions illustrated in FIGS. 7 and 8. Hence, this proposal appears to provide a larger heat transfer area and as such an enhanced heat transfer between the coolant and the sleeve. However, this proposal teaches a roll construction in which the width of the coolant groove between adjacent load bearing members is much thinner than the width of each of the multiplicity of load bearing members. Disadvantageously, the load bearing members are prone to deformation and damage due to radially inwardly directed forces applied to the other periphery of the sleeve. Damage to the load bearing members distorts and damages the shape, configuration and size of the coolant grooves. Because of the narrowness of the coolant grooves, they are particularly susceptible to blockage as a result of such damage.

An object of the present invention is to overcome or at least alleviate one or more of the above identified deficiencies and/or difficulties.

DISCLOSURE OF THE INVENTION

According to the invention there is provided a casting roll comprising a roll body, a sleeve fitted over the roll body longitudinally extending and coolant passages defined between said roll body and said sleeve for passage of coolant therethrough, wherein a plurality of axially extending load bearing members having a predetermined width and a predetermined height are interposed between and in contact with said roll body and said sleeve so that adjacent load bearing members further define said coolant passages, and wherein said sleeve is provided with a plurality of inwardly directed axially extending fins disposed between adjacent load bearing members, each fin having a width thinner than that of the load bearing members and a height shorter than that of the load bearing members so that said fins project into said coolant passages.

Preferably, the load bearing members are formed on the sleeve.

Additionally, and/or alternatively the load bearing members are formed on the roll body.

The width of the load bearing members formed in the roll body can be thinner than that of corresponding loading bearing members formed in the sleeve in embodiments in which the strength of the roll body material is higher than that of the sleeve material. This facilitates the use of fewer load bearing members, the provision of wider coolant passages, and hence the provision of more fins and a higher heat transfer area.

It is preferred that each load bearing member is substantially as wide as it is high.

Preferably adjacent load bearing members are spaced apart a distance in the range 10 mm to 100 mm.

More preferably, the height of each fin is shorter than the height of the load bearing members by more than 1.2 microns to 1 mm.

In accordance with a first embodiment, the invention provides a casting roll for a twin roll caster comprising a roll body made of a metal material having high rigidity and a sleeve made of a metal material having high thermal conductivity for covering an outer periphery of the roll body, cooling water passages being defined between said roll body and said sleeve for passage of the cooling water therethrough, characterised in that a plurality of load bearing members having a predetermined width are provided peripherally on the outer periphery of said roll body, said load bearing members being of a predetermined height to be in contact with an inner periphery of said sleeve and extending axially of the roll, a plurality of fins, each having a thinner width and shorter height than those of the load bearing members, being provided on the inner periphery of said sleeve between the adjacent load bearing members and extending axially of the roll, the cooling water passages being provided in the form of gaps defined between said roll body and said sleeve.

In accordance with a second embodiment, the load bearing members of the first embodiment are alternatively formed on the sleeve.

The invention also provides a twin roll caster having a pair of casting rolls according to the invention wherein the height of each fin is shorter than the height of the load bearing members by a distance sufficient to prevent the tip of each fin touching the roll body under stable casting conditions.

Additionally, the invention further provides a twin roll caster having casting rolls according to the invention wherein the height of each fin is shorter than the height of the load bearing members by a distance sufficient to prevent permanent deformation of each fin due to loads applied axially to each roll under stable casting conditions.

Therefore, according to the invention, sufficiently high rigidity is facilitated by the provision of load bearing members having a relatively thick width peripherally on the outer periphery of the roll body or on the inner periphery of the sleeve. Moreover, the fact that the fins on the inner periphery of the sleeve between the adjacent load bearing members are shorter in height than the load bearing members, positively prevents or at least minimises the risk of the tip end of each fin from contacting the outer periphery of the roll body and therefore prevents or at least minimise the risk of the fins from being bent and deformed.

Moreover, the provision of fins having a relatively thin width in numbers on the inner periphery of the sleeve between the adjacent load bearing members contributes to extensively increasing the heat transfer area of the sleeve.

Accordingly the present invention provides a casting roll for a twin roll continuous caster, having a sufficiently high rigidity to prevent or at least minimise damage of the cooling water passages when the solidified shells are brought together between the rolls, and/or having an enhanced heat transfer area.

BRIEF DESCRIPTION OF THE DRAWINGS

In order that the invention may be more fully explained two particular embodiments will be described in some detail with reference to the accompanying drawings in which.

DETAILED DESCRIPTION OF THE PREFERRED EMBODIMENTS

Figure 6:
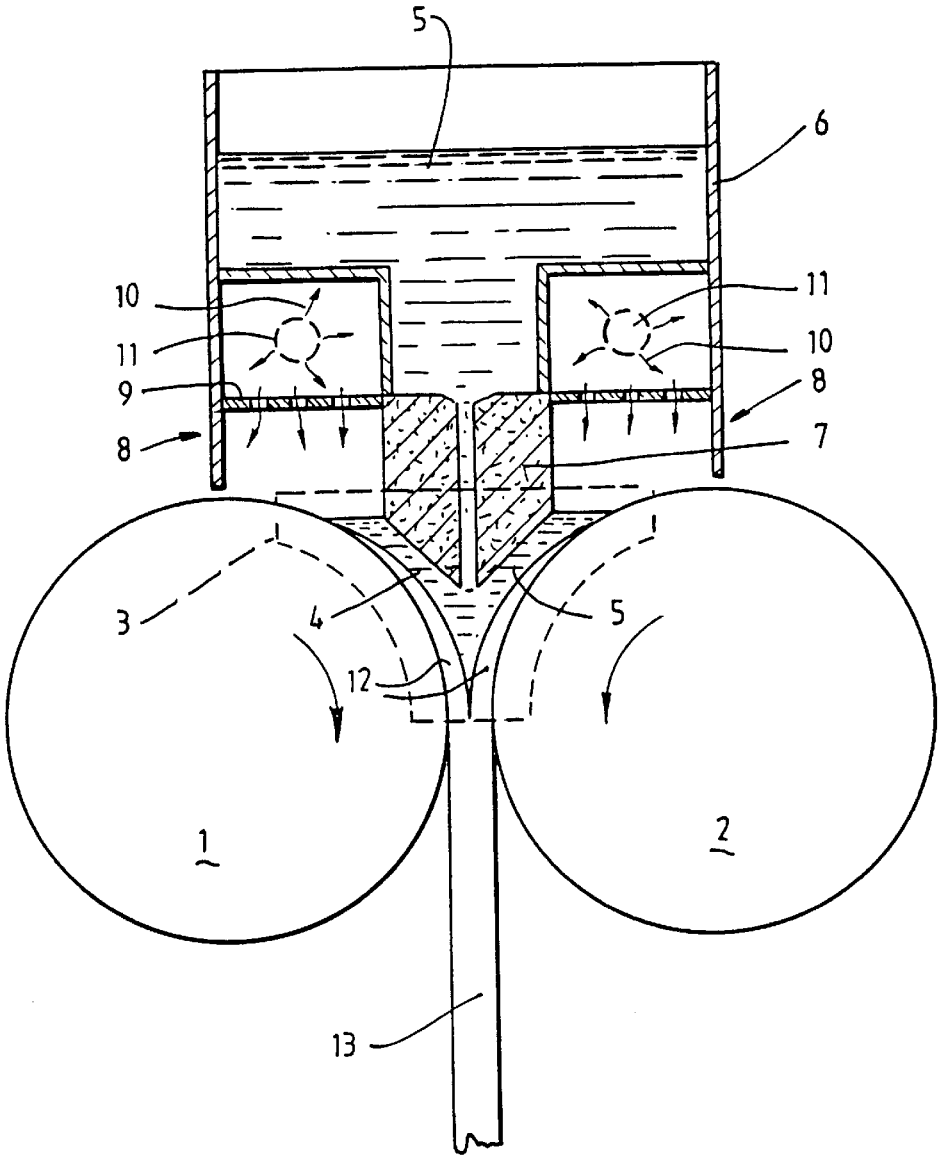
FIG. 6 PRIOR ART
FIG. 6 is a schematic front view of a typical twin roll continuous caster of the prior art.
Figure 7:
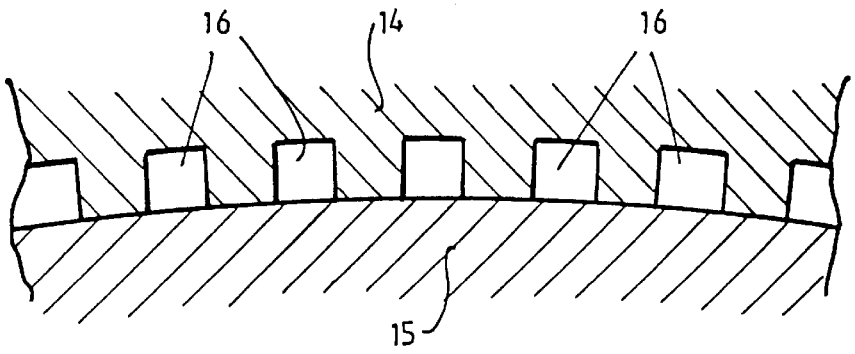
FIG. 7. PRIOR ART
FIG. 7 is a partially enlarged view illustrating a casting roll of the prior art.
Figure 8:
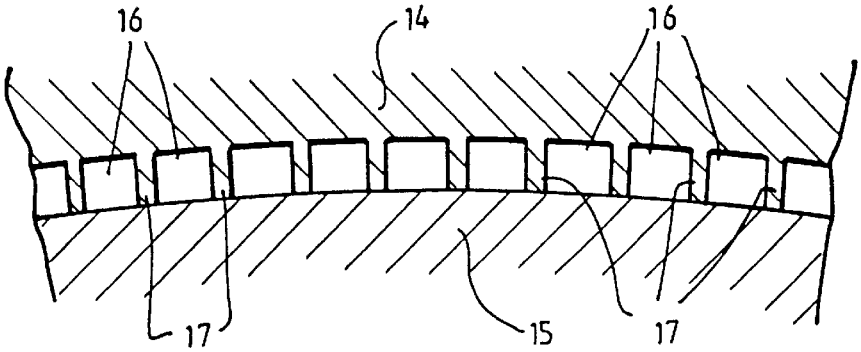
FIG. 8 is a partially enlarged view showing a further casting roll of the prior art.

FIGS. 1 to 4 illustrates an embodiment of a casting roll constructed in accordance with the invention. In the figures, reference numeral 18 denotes a roll used in a twin roll continuous caster as shown in FIG. 6. The roll 18 comprises a roll body 19 made of a material such as stainless steel having high rigidity and a cylindrical sleeve 20 made of a material such as copper alloy having high thermal conductivity and mounted to cover the outer periphery of the roll body 19. The roll is rotatably supported via spindles 21 and 22 protruding on axially opposite ends of the roll body 19. The spindle 22 on one side (the right in FIG. 1) is connected to a drive (not shown) for rotation.

A plurality of load bearing members 23 having a relatively thick width are provided on an outer periphery of the roll body 19 at a predetermined peripheral spacing with each other, are in contact with the inner periphery of the sleeve 20 and extend axially of the roll. On the inner periphery of the sleeve 20 between the adjacent load bearing members 23, a plurality of fins 24 with thinner width are provided which extend axially of the roll and are shorter in height than the load bearing members 23. With the load bearing members 23 and the fins 24 arranged as described above, longitudinal cooling water passages 25 are provided in the form of gaps between the roll body 19 and the sleeve 20 (See FIG. 2).

The width of each load bearing member 23 must be sized to be relatively large such that high rigidity is ensured not to cause any bending and deformation even when reactive force is applied when the solidified shells are brought together between the rolls 18. Typically, the width of each load bearing member 23 may be sized to be substantially the same as height of the load bearing members so as to ensure sufficient rigidity.

The spindle 22 on the drive side (the right in FIG. 1) of the roll body 19 is of dual tube structure comprising outer and inner tubes 26 and 27. The inner tube 27 is connected at its end on the work side to a water supply bore 28 of the roll body 19 so that a water supply passage 29 formed in the inner tube 27 is communicated with the bore 28.

From an end of the bore 28 on the work side (the left in FIG. 1), a plurality of distribution passages extend radially outwardly. Each of the distribution passages 30 is connected at its tip end to ends if the corresponding cooling water passages 25 on the work side via a water supply header 31.

On the other hand, from an end on the work side of a water drain passage 32 formed between the outer and inner tubes 26 and 27 of the spindle 22, a plurality of recovery passages 33 extend radially outwardly. Each of the recovery passages 33 is connected at its tip end to ends of the corresponding cooling water passages 25 on the drive side via a water drain header 34.

When cooling water is supplied to the passage 29 in the inner tube 27 of the spindle 22 on the drive side, the cooling water flows through the water supply bore 28 of the roll body 19, the distribution passages 30 and the water supply headers 31 to the ends of the cooling water passages 25 on the work side. Flowing through the cooling water passages 25 axially of the roll, the water reaches the ends of the passages 25 on the drive side and then flows through the water drain headers 34 and the recovery passages 33 and is discharged to the water drain passage 32 between the outer and inner tubes 26 and 27. Thus, the sleeve 20 is cooled by the cooling water passing through the cooling water passages 25.

In this case, high rigidity is ensured by the load bearing members 23 having thicker width and provided peripherally on the outer periphery of the roll body 19. The fins 24 formed on the inner periphery of the sleeve between the adjacent load bearing members 23 are shorter in height than the load bearing members 23, which fact prevents the tip end of each fin 24 from contacting the outer periphery of the roll body 19, and bending and deformation can be positively avoided.

The fact that the fins 24 having thinner width are arranged in numbers on the inner periphery of the sleeve 20 between the adjacent load bearing members 23 contributes to extensively increasing the heat transfer area on the sleeve 20.

Therefore, according to this embodiment, the heat transfer area can be increased while maintaining high rigidity not to cause any damage of the cooling water passage 25 when the solidified shells are brought together between the rolls 18. Thus, good thermal transfer can be ensured without extensively increasing the cooling-water flow rate. It is possible to reduce the supply pressure to pass the cooling water, thereby reducing the running cost.

Since the sleeve 20 can be efficiently cooled, thermal fatigue of the sleeve 20 can lie extensively decreased, and the damage of the cooling water passage 25 due to bending and deformation can be positively prevented, which facts contribute to elongating the service life of the rolls 18.

Further, the sleeve 20 can be efficiently cooled and therefore the efficiency for solidifying the molten metal can be improved, so that productivity can be enhanced by increasing the rotating speed of the rolls.

Figure 1:
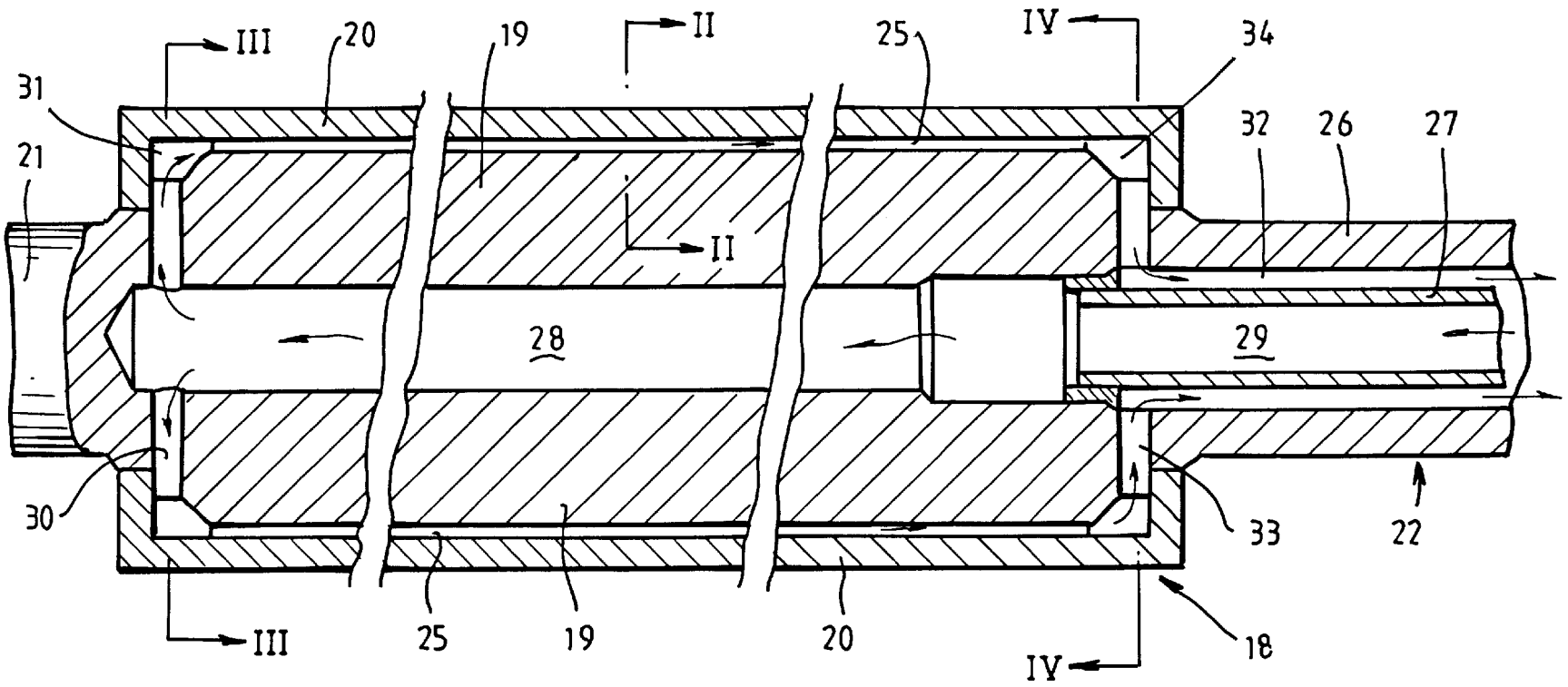
FIG. 1 is a longitudinal cross-section through one embodiment of a casting roll constructed in accordance with the invention.
Figure 2:
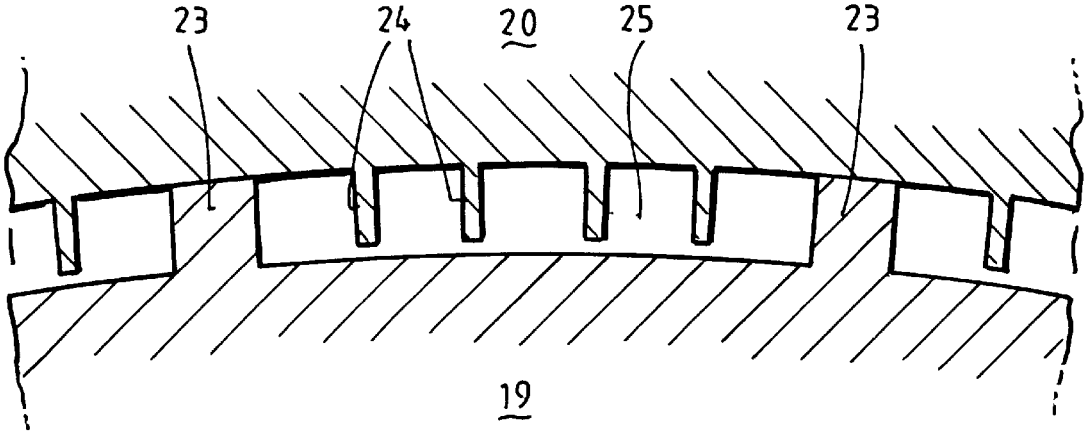
FIG. 2 is a partially enlarged view looking in the direction of arrows II in FIG. 1.
Figure 3:
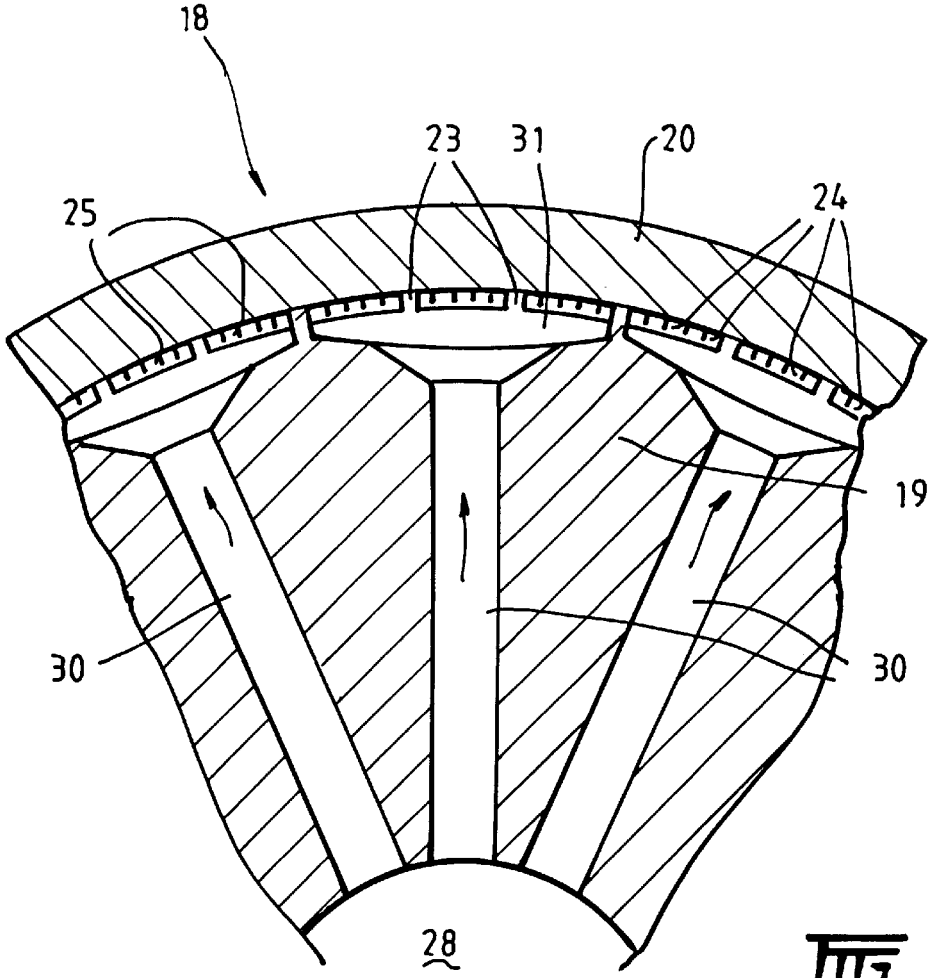
FIG. 3 is a view looking in the direction of arrows III In FIG. 1.
Figure 4:
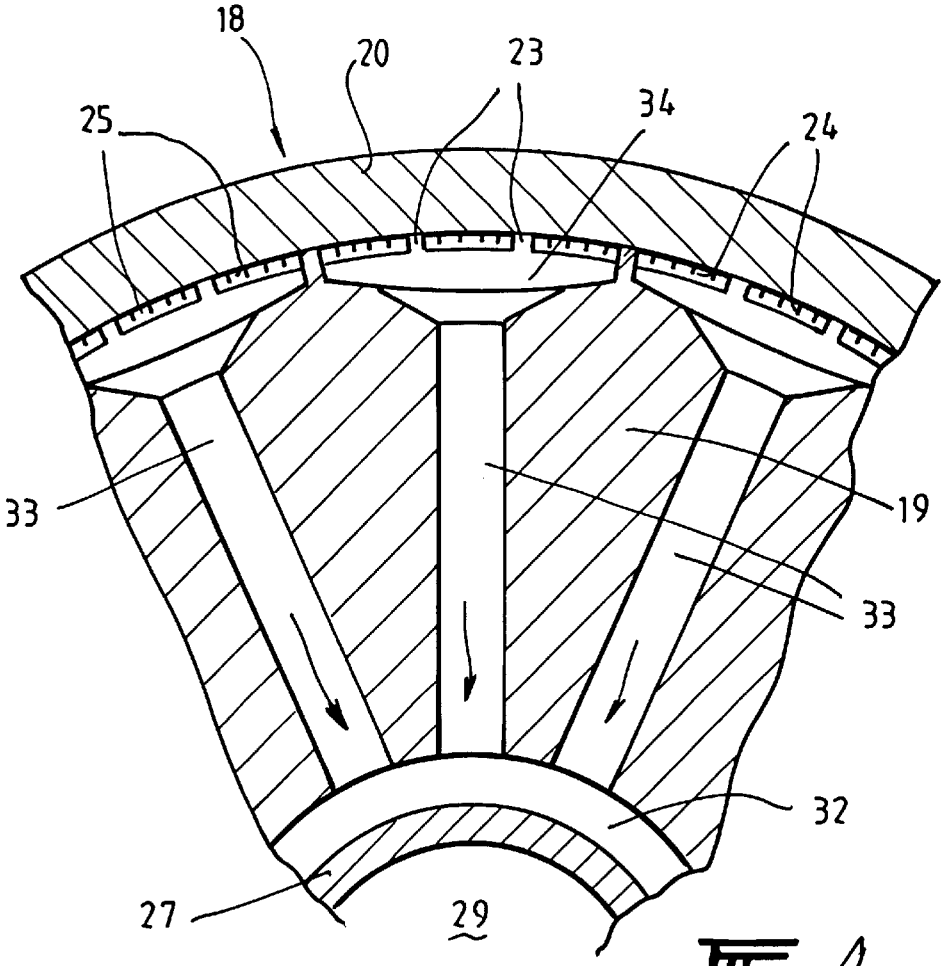
FIG. 4 is a view looking in the direction of arrows IV in FIG. 1.
Figure 5:
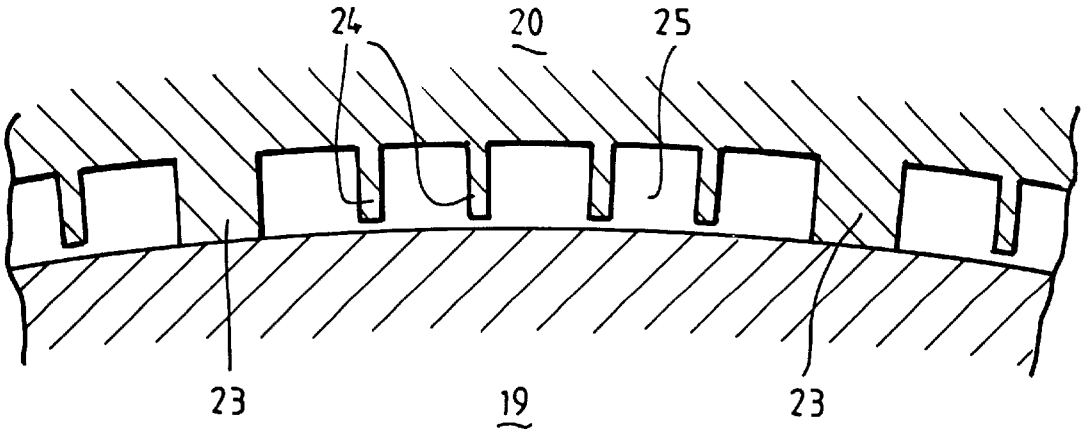
FIG. 5 is a partially enlarged view illustrating a further embodiment of a casting roll constructed in accordance with the invention.

FIG. 5 illustrates a further embodiment of the invention in which the load bearing members 23 are provided on the sleeve 20.

More specifically, in the further embodiment, a plurality of load bearing members 23 with thicker width are provided on the inner periphery of the sleeve 20. The load bearing members 23 are in contact with the outer periphery of the roll body 19 and extend axially of the roll. A plurality of fins 24 with thinner width and shorter in height than the load bearing members 23 are provided on the inner periphery of the sleeve 20 between the adjacent load bearing members 23 and extend axially of the roll. The cooling water passages 25 are formed in the form of gaps between the roll body 19 and the sleeve 20.

In this case, the same operative effects can be obtained as in the first-mentioned embodiment. Moreover the cooling water passages 25 can be formed simply by machining the grooves on the sleeve 20, which facilitates the manufacture and contributes to reducing the manufacturing cost.

The illustrated casting rolls of the invention may typically be of the order of 500 mm diameter and have an outer sleeve thickness of the order of 20–35 mm. The longitudinal cooling water passages between adjacent load bearing members may typically be of the order of 4 mm deep×20 mm wide.

It has been found that when the distance between adjacent loading bearing members is in the range 10 mm to 100 mm, the maximum deflection of the sleeve due to the inward pressure exerted to the sleeve from the solidifying strip in a typical twin roll caster is about 1.2 microns. Hence it is preferred that the height of each fin is shorter than the height of the load bearing members by more than 1.2 micron to 1 mm, thereby ensuring that the tip of each fin does not touch the roll body under the pressure of the solidifying strip, and that each fin is free from buckling or fatigue failure, without significantly decreasing cooling efficiency.

However, the height of the fin may be shorter than the height of the load bearing member by say 1 micron so that the tip touches the roll body under maximum sleeve deflection without permanent deformation of the fin. The fins of the invention are not adapted to perform the loading bearing function of the load bearing members.

According to the invention, the following excellent effects will be obtained:

(I) The heat transfer area can be increased while ensuring high rigidity not to cause any damage of the cooling water passages even when the solidified shells are brought together between the rolls of a twin roll caster, so that good thermal transfer can be ensured without extensively increasing the cooling-water flow rate and the supply pressure to pass the cooling water can be reduced, which facts contribute to reducing the running cost.

(II) The sleeve can be efficiently cooled to extensively reduce thermal fatigue of the sleeve and the cooling water passages can be positively prevented from being damaged due to bending and deformation, which facts contribute to elongating the service life of the rolls.

(III) The sleeve can be cooled efficiently and therefore the efficiency to solidify tie molten metal can be improved, so that productivity can be enhanced by increasing the rotating speed of the rolls.

(IV) In the case where the load bearing members are provided on the sleeve, the cooling water passages can be formed simply by machining grooves on the sleeve, which fact facilitates the manufacture and contributes to reducing the manufacturing cost.

It is to be understood that the casting roll for the twin roll continuous caster according to the invention is not limited to the above embodiments and that various modifications may be made without departing from the scope and the spirit of the invention.

What is claimed is:

1. A casting roll comprising:

a roll body, a sleeve fitted over the roll body and longitudinally extending coolant passages defined between said roll body and said sleeve for passage of coolant therethrough, wherein a plurality of axially extending load bearing members having a predetermined width and a predetermined height are interposed between and in contact with said roll body and said sleeve, so that adjacent load bearing members further define said coolant passages and wherein said sleeve is provided with a plurality of inwardly directly axially extending fins disposed between adjacent load bearing members, each fin having a width thinner than that of the load bearing members and a height shorter than that of the load bearing members so that said fins project into said coolant passages.

2. A casting roll as claimed in claim 1, wherein the load bearing members are formed on the sleeve.

3. A casting roll as claimed in claim 1, wherein the load bearing members are formed on the roll body.

4. A casting roll as claimed in claim 1, wherein each load bearing member is substantially as wide as it is high.

5. A casting roll as claims in claim 1, wherein the roll body comprises a metal material having high rigidity.

6. A casting roll according to claim 5, wherein the metal material is stainless steel.

7. A casting roll according to claim 1, wherein the sleeve comprises a metal material having high thermal conductivity.

8. A casting roll according to claim 7, wherein the metal material is a copper alloy.

9. A casting roll according to claim 1, wherein adjacent load bearing members are spaced apart a distance in the range from 10 mm to 100 mm.

10. A casting roll according to claim 1, wherein the height of each fin is shorter than the height of the load bearing members by more than 1.2 microns to 1 mm.

11. A twin roll caster having a pair of casting rolls wherein each casting roll comprises:

a roll body, a sleeve fitted over the roll body and longitudinally extending coolant passages defined between said roll body and said sleeve for passage of coolant therethrough, wherein a plurality of axially extending load bearing members having a predetermined width and a predetermined height are interposed between and in contact with said roll body and said sleeve, so that adjacent load bearing members further define said coolant passages and wherein said sleeve is provided with a plurality of inwardly directly axially extending fins disposed between adjacent load bearing members, each fin having a width thinner than that of the load bearing members and a height shorter than that of the load bearing members so that said fins project into said coolant passages.

12. A twin roll caster according to claim 11, wherein the height of each fin is shorter than the height of the load bearing members by a distance sufficient to prevent the tip of each fin touching the roll body under stable casting conditions.

13. A twin roll caster according to claim 11, wherein the height of each fin is shorter than the height of the load bearing members by a distance sufficient to prevent permanent deformation of each fin due to loads applied axially to each roll under stable casting conditions.

* * * * *